United States Patent [19]

Horodysky et al.

[11] 4,421,659

[45] Dec. 20, 1983

[54] ZWITTERIONIC QUATERNARY AMMONIUM SULFATES AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 393,899

[22] Filed: Jun. 30, 1982

[51] Int. Cl.[3] ..... C10M 1/40

[52] U.S. Cl. ..... 252/33; 44/53; 44/56; 44/57; 44/63; 252/33.6; 252/34; 252/47.5; 252/391; 252/392; 252/402; 252/403; 548/354

[58] Field of Search ..... 44/63, 53, 56, 57; 252/391, 392, 402, 403, 33.6, 47.5, 34, 33; 548/354

[56] References Cited

U.S. PATENT DOCUMENTS

| | | | |
|---|---|---|---|
| 2,668,100 | 2/1954 | Luvisi | 44/63 |
| 3,115,397 | 12/1963 | Fareri et al. | 44/63 |
| 3,187,003 | 6/1965 | McBride, Jr. | 44/63 |
| 3,231,582 | 1/1966 | Mannheimer et al. | 548/354 |
| 3,259,477 | 7/1966 | Ubelhofen | 44/63 |
| 3,574,100 | 4/1971 | Wetmore | 252/33.6 |
| 4,265,810 | 5/1981 | Bauman et al. | 548/354 |
| 4,301,044 | 11/1981 | Wentler et al. | 548/354 |

*Primary Examiner*—Charles F. Warren
*Assistant Examiner*—Y. Harris-Smith
*Attorney, Agent, or Firm*—Alexander J. McKillop; Michael G. Gilman; Claude E. Setliff

[57] ABSTRACT

Zwitterionic quaternary ammonium sulfates of the formulas hereinafter disclosed are provided as new compounds and as effective lubricant and fuel additives. They are multifunctional, having, among others, the ability to reduce corrosion, oxidation and friction in, for example, an internal combustion engine and thereby to reduce fuel consumption.

28 Claims, No Drawings

ZWITTERIONIC QUATERNARY AMMONIUM SULFATES AND LUBRICANTS CONTAINING SAME

BACKGROUND OF THE INVENTION

1. Field of the Invention

The invention is concerned with a novel group of compounds and their use in lubricants or liquid fuels as friction reducers, antioxidants, antiwear, anticorrosion additives (i.e., non-corrosive to copper).

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them. Further, no art is known that suggests their use in lubricants or fuels.

SUMMARY OF THE INVENTION

In accordance with the invention, there is provided a compound of one of the formulas

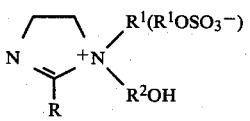

I or

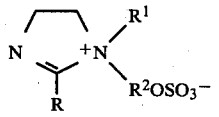

II

R is a $C_7$ to $C_{31}$ hydrocarbyl group, $R^1$ is an alkyl or alkylene group containing from 1 or to 2 carbon atoms and $R^2$ is a hydrocarbylene group containing from 2 to 6 carbon atoms. While hydrocarbyl and hydrocarbylene can be alkyl, alkylene, aryl, alkaryl, aralkyl or cycloaliphatic groups such as cyclohexane. Preferably R is an alkyl group and $R^2$ is an alkylene group, the alkyl groups containing 9 to 20 carbon atoms. The aryl groups mentioned may have 6 to 14 carbon atoms, i.e. phenyl, naphthyl and anthryl. In the aralkyl and alkaryl groups, the aryl portion is one of these, and the alkyl portion will range to the maximum number of carbon atoms specified. For example aralkyl can be phenethyl and the like and alkaryl can be the xylenes, ethylphenyl, and the like.

The invention also provides a lubricant or liquid hydrocarbon fuel composition comprising a lubricant or fuel and a friction reducing or antiwear amount of the product. It is further contemplated that the product will aid in the reduction of fuel consumption in an internal combustion engine.

DESCRIPTION OF SPECIFIC EMBODIMENTS

The compounds of this invention, formula I, are made from certain imidazolines and dialkyl sulfates. As specifically illustrated in Example 1, 1-(2-hydroxyethyl)-2-heptadecenyl imidazoline is reacted with diethyl sulfate. The compounds of formula II are made by reacting the compound of Formula I with, for example, sulfamic acid.

The reaction between the imidazoline and diethyl sulfate can be run at from about 30° C. to about 70° C., preferably about 40° C. to about 60° C. The reaction of the product thus obtained with sulfamic acid can be carried out at from about 90° C. to about 170° C., preferably from about 100° C. to about 140° C. The temperature chosen will depend to a large extent on the particular reactants and on whether or not a solvent is used. In carrying out this reaction, it is preferable that quantities of reactants be chosen such that the ratio of imidazoline to sulfate or of that product to sulfamic acid is about 1:6 to about 1:1.

While atmospheric pressure is generally preferred, the reaction can be advantageously run at from about 1 to about 5 atmospheres. As already noted, where conditions warrant it, a solvent may be used. In general, any relatively non-polar, unreactive solvent such as ethylene dichloride or methylene chloride can be used for the alkylation with diethyl sulfate, while a polar aprotic solvent such as dimethyl formamide (DMF) is preferred for the sulfamic acid reaction.

The times for the reactions are not critical. Thus, any phase of the process can be carried out in from about 1 to about 20 hours.

Of particular significance, in accordance with the present invention, is the ability to improve the resistance to oxidation and corrosion of oleaginous materials such as lubricating media which may comprise liquid oils, in the form of either a mineral oil or a synthetic oil, or mixtures thereof, or in the form of a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic coils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylehexyl)sebacate, di(2-ethylhexyl)adipate, dibutyl phthalate, fluorocarbons, silicate esters, silanes, esters of phosphorous-containing acids, liquid ureas ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

It is to be understood, however, that the compositions contemplated herein can also contain other materials. For example, corrosion inhibitors, extreme pressure agents, viscosity index improvers, pour point depressants, detergents, dispersants, co-antioxidants, antiwear agents and the like can be used. These include, but are not limited to, phenates, sulfonates, succinimides, zinc dialkyl dithiophosphates, polymethoxylates, olefin copolymers and the like. These materials do not detract from the value of the compositions of this invention, but rather serve to impart their customary properties to the particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, dispersants, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions." Specifications for low-temperature and aircraft fluids are defined in U.S. Government Specification MIL-H-5606A.

In addition, the oxidation and corrosion resistance of functional fluids such as hydraulic fluids can be improved by the adducts of the present invention.

The fuels that may be used for the purposes of this invention include (1) liquid hydrocarbon fuel, such as diesel oil, fuel oil and gasoline, (2) alcohol fuels such as methanol and ethanol and (3) mixtures thereof.

In general, the reaction products of the present invention may be employed in any amount which is effective for imparting the desired degree of friction reduction or antiwear activity. In many applications, however, the product is effectively employed in amounts from about 0.1% to about 10% by weight, and preferably from about 1% to about 5% of the total weight of the composition.

The following Examples will present illustrations of the invention. They are illustrative only, and are not meant to limit the invention

EXAMPLE 1

Synthesis of 1-ethyl, 1-(2-hydroxyethyl)-2-heptadecenyl imidazoline ammonium ethyl sulfate salt 61 g of diethyl sulfate was added dropwise in 1½ hours to 139 g of 1-(2-hydroxyethyl)-2-heptadecenyl imidazoline, obtained commercially, in 440 cc dry ethylene dichloride. The reaction was maintained between 40° and 50° C. during addition and then allowed to proceed at room temperature for 17 hours. 95% ethanol was added, the pH was increased to 8.6 and the solvents were removed by vacuum distillation. The residue was dissolved in toluene and filtered through diatomaceous earth. Toluene was removed from the filtrate via vacuum distillation yielding a dark brown viscous oil.

EXAMPLE 2

Synthesis of 1-ethyl, 1-(2-sulfatoethyl)-2-heptadecenyl imidazoline ammonium inner salt 100 g of 1-ethyl, 1-(2-hydroxyethyl)-2-heptadecenyl imidazoline ammonium salt, prepared as described in Example 1, and 21.5 g sulfamic acid were refluxed in dimethylformamide (DMF) solvent at 110° to 130° C. for 18 hours. The reaction mixture was filtered at room temperature, and DMF was removed by vacuum distillation. The resulting product was a viscous, dark reddish-brown oil.

EVALUATION OF THE COMPOUNDS

The compounds were evaluated in a Low Velocity Friction Apparatus (LVFA) in a fully formulated 5W-30 synthetic automotive engine oil containing an additive package including antioxidant, dispersant and detergent. The test compound was 4% and 2% of the total weight of oil.

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission drive by a ½ HP electric motor. To vary the sliding speed, the output speed of the transmission is regulated by a lever-cammotor arrangement.

Procedure

The rubbing surfaces and 12–13 ml of test lubricants are placed on the LVFA. A 240 psi load is applied, and the sliding speed is maintained at 40 fpm at ambient temperature for a few minutes. A plot of coefficients of friction ($U_k$) vs. speed were taken at 240, 300, 400 and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

The fully formated 5W-30 synthetic lubricating oil containing a detergent/dispersant/inhibitor package had the following general characterstics:

Viscosity at 100° C.—11.0

Viscosity at 40° C.—58.0

Viscosity Index—172

TABLE 1

EVALUATION OF FRICTION REDUCING CHARACTERISTICS

| Medium and Additive | Additive Conc. Wt. % | % Change in Coefficient of Friction @ 5 Ft./Min. | 30 Ft./Min. |
|---|---|---|---|
| Base Oil (SAE 5W-30) | — | 0 | 0 |
| Example 1 in Oil | 4 | 32 | 31 |
| | 2 | 23 | 28 |
| | ½ | 24 | 19 |
| Example 2 in Oil | 4 | 22 | 14 |

Representative samples of the above prepared compositions were also evaluated for antioxidant properties with a catalytic oxidation test. Samples of 200" solvent parafinic neutral mineral lubricating oil were placed in an oven at 325° F. Present in the samples were the following metals, either known to catalyze organic oxidation or commonly used materials of construction:

a. 15.6 sq. in. of sand-blasted iron wire b. 0.78 sq. in. of polished copper wire c. 0.87 sq. in. of polished aluminum wire d. 0.167 sq. in. of polished lead surface Dry air was passed through the sample at a rate of about 5 liters per hour for 40 hours. Table 2 shows the data.

TABLE 2

Catalytic Oxidation Test 40 Hours @ 325° F.

| Medium and Additive | Additive Conc. Wt. % | Lead Loss, mg | % Increase in Viscosity of Oxidized Oil using KV @ 210° F. | Neut. No., NN |
|---|---|---|---|---|
| Base Oil | — | −0.2 | 4.2 | 3.52 |
| Example 1 in Oil | 2 | −0.03 | 2.7 | 3.25 |

These compounds were non-corrosive to copper as measured in 200" solvent paraffinic neutral lubricating oil using the ASTM D130-80 Copper Strip Corrosivity Test. This is shown in Table 3.

TABLE 3

Copper Strip Corrosivity

| Medium and Additive | Additive Conc. Wt. % | Test Rating ASTM D130-80 3 Hrs. @ 250° F. | ASTM D130-80 6 Hrs. @ 210° F. |
|---|---|---|---|
| Example 1 in Oil | 2 | 1A | 1A |

It is apparent from the above data that the products of this invention are effective in several uses. That is, they reduce friction and thereby help to decrease fuel consumption, they are extremely effective antioxidants and are non-corrosive to copper.

We claim:

1. A compound of the formula

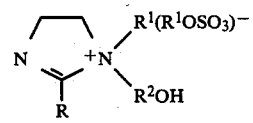

I or

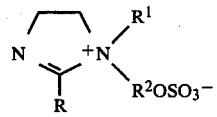

II wherein R is a $C_7$ to $C_{31}$ hydrocarbyl group, $R^1$ is an alkyl or alkylene group containing 1 or 2 carbon atoms and $R^2$ is a hydrocarbylene group containing 2 to 6 carbon atoms.

2. The compound of claim 1 wherein R is selected from alkyl, aryl, alkaryl, aralkyl and cycloaliphatic groups.

3. The compound of claim 2 wherein the aryl group contains from 6 to 14 carbon atoms.

4. The compound of claim 3 wherein the aryl group is phenyl, naphthyl or anthryl.

5. The compound of claim 2 wherein the alkyl group contains 9 to 20 carbon atoms.

6. The compound of claim 1 wherein $R^2$ is alkylene.

7. The compound of claim 1, formula I, wherein R is a heptadecenyl group and $R^1$ and $R^2$ are ethyl groups.

8. The compound of claim 1, formula II, wherein R is a heptadecenyl group and $R^1$ and $R^2$ are ethyl groups.

9. A lubricant or liquid fuel composition comprising a major proportion of a lubricant or fuel and a friction reducing amount of a compound of the formula:

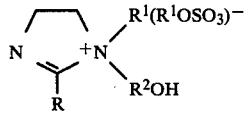

I or

-continued

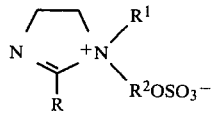

II wherein R is a $C_7$ to $C_{31}$ hydrocarbyl group, $R^1$ is an alkyl or alkylene group containing 1 to 2 carbon atoms and $R^2$ is a hydrocarbylene group containing 2 to 6 carbon atoms.

10. The composition of claim 9 wherein in the compound R is selected from alkyl, aryl, alkaryl, aralkyl and cycloaliphatic groups.

11. The composition of claim 10 wherein in the compound the aryl group contains from 6 to 14 carbon atoms.

12. The composition of claim 11 wherein in the compound the aryl group is phenyl, naphthyl or anthryl.

13. The composition of claim 10 wherein in the compound the alkyl group contains 9 to 20 carbon atoms.

14. The composition of claim 9 wherein in the compound $R^2$ is alkylene.

15. The composition of claim 9 wherein in the compound of formula 1 R is a heptadecenyl group and $R^1$ and $R^2$ are ethyl groups.

16. The composition of claim 9 wherein in the compound of formula II R is a heptadecenyl group and $R^1$ and $R^2$ are ethyl group.

17. The composition of claims 9, 10, 11, 12, 13, 14, 15, or 16 wherein the lubricant is (1) a mineral oil, (2) a synthetic oil or mixtures of synthetic oils, (3) a mixture of (1) and (2), or (3) a grease from these.

18. The composition of claim 17 wherein the lubricant is a synthetic oil or a mixture of synthetic oils.

19. The composition of claim 9 wherein the lubricant is a mineral oil.

20. The composition of claim 9 wherein the lubricant is a mixture of mineral and synthetic oils.

21. The composition of claim 9 wherein the lubricant is a grease.

22. The composition of claim 9 wherein the fuel is a liquid hydrocarbon.

23. The composition of claim 22 wherein the hydrocarbon is a diesel oil.

24. The composition of claim 22 wherein the hydrocarbon is a fuel oil.

25. The composition of claim 22 wherein the hydrocarbon is a gasoline.

26. The composition of claim 9 wherein the fuel is an alcohol or mixtures thereof.

27. The composition of claim 26 wherein the alcohol is methanol.

28. The composition of claim 26 wherein the alcohol is ethanol.

* * * * *